United States Patent [19]

Mengeringhausen et al.

[11] Patent Number: 4,723,384

[45] Date of Patent: Feb. 9, 1988

[54] RAPID-CONSTRUCTION FRAMEWORK, ESPECIALLY OF STEEL, AS SUPPORT STRUCTURE FOR CEILING AND WALL PLATES OF A BUILDING

[75] Inventors: Max Mengeringhausen, Hofmeierstr. 14, D-8700 Würzburg; Martin Brillinger; Winfried Werrlein, both of Würzburg, all of Fed. Rep. of Germany

[73] Assignee: Ing. Max Mengeringhausen, Wurzburg, Fed. Rep. of Germany

[21] Appl. No.: 725,803

[22] Filed: Apr. 22, 1985

[30] Foreign Application Priority Data

Apr. 25, 1984 [DE] Fed. Rep. of Germany ..... 3415344

[51] Int. Cl.[4] ..... E04G 7/20; E04B 1/19

[52] U.S. Cl. ..... 52/126.1; 52/646; 52/637; 182/178

[58] Field of Search ..... 52/646, 637, 638, 648, 52/585, 126.1; 182/178; 403/292, 298, 300, 302, 305

[56] References Cited

U.S. PATENT DOCUMENTS

| | | | |
|---|---|---|---|
| 2,449,069 | 9/1948 | Harrison | 52/637 |
| 3,822,519 | 7/1974 | Antoniou | 52/585 |

FOREIGN PATENT DOCUMENTS

| | | | |
|---|---|---|---|
| 417041 | 2/1967 | Fed. Rep. of Germany | 182/178 |
| 1025802 | 4/1966 | United Kingdom | 52/638 |

*Primary Examiner*—John E. Murtagh

*Attorney, Agent, or Firm*—Quaintance, Murphy & Presta

[57] ABSTRACT

In order to decrease the number of different structural elements required and to expedite the assembly of a rapid-construction framework as a support structure for ceilings and wall plates of a building, modular connections are used, each having four shaped guide bars, for connection of supports with tie bars of the rapid-construction framework, which are brought into force- and form-locking engagement with the hollow spaces of the supports or hollow main elements at the ends of the tie bars, for the assembly of the framework. Main elements, which are hollow on the tie bar side, are of the same dimensions and are welded in the same manner to the ends of the tie bars. A leveling member 40 is of diameter to that of the supports.

4 Claims, 8 Drawing Figures

RAPID-CONSTRUCTION FRAMEWORK, ESPECIALLY OF STEEL, AS SUPPORT STRUCTURE FOR CEILING AND WALL PLATES OF A BUILDING

BACKGROUND OF THE INVENTION

The present invention relates to a rapid-construction framework, especially of steel, as a support structure for ceiling and wall plates of a building, with perpendicular supports and horizontal tie bars, all with uniform section and each with coupling elements at both ends, to produce plug connections with bottom and/or top supports, wherein each of the coupling elements comprises a main element which is hollow on the tie bar side with four shaped guide bars arranged therein, wherein at least one attached support and at least one main element, in the hollow space, engage on another tie bar, force- and form-locking and have an angular section.

In accordance with a prior construction by the inventors herein, a modular rapid-construction framework comprises perpendicular supports arranged in the grating in the form of hollow shaped bars of square section and horizontal tie bars. Tie bars and supports are connected by coupling elements welded onto both ends of the tie bar, the coupling elements being in the form of hollow main elements with shaped guide bars arranged therein, wherein at least one support and at least one main element, in the hollow space, engage on another tie bar. A special feature of this prior construction is that the shaped guide bars are open lengthwise and especially are configured as angular. Tolerance problems can thus be eliminated in a simple manner and the welding seams between the shaped guide bars and the main elements holding them can be arranged so that they do not hinder the precise fit of the framework parts.

An object of the present invention is to further improve the aforementioned prior construction, so that fewer different structural elements are needed and the assembly is further expedited in order to attain increased economy.

SUMMARY OF THE INVENTION

The present invention provides a rapid-construction framework of the aforementioned type, wherein the four shaped structural bars or beams are fitted together in an independent modular connection, while all the main elements of the rapid-construction framework on the tie bar side have a free lightweight rectangular section and are of the same dimensions for its assembly. These modular connections, as well as the tie bars, can be economically mass produced and stored. It is advantageous that different wall combinations can be economically constructed with standard or modular tie bars and the hollow structural bars or beams serving as supports and only to be cut to length, which also can be manufactured and stored, so that the axes of the couplings and the supports always fit together.

BRIEF DESCRIPTION OF THE DRAWINGS

The invention is explained hereinafter relative to the drawings of exemplary embodiments. They show.

DESCRIPTION OF THE PREFERRED EMBODIMENTS

Figure 1:
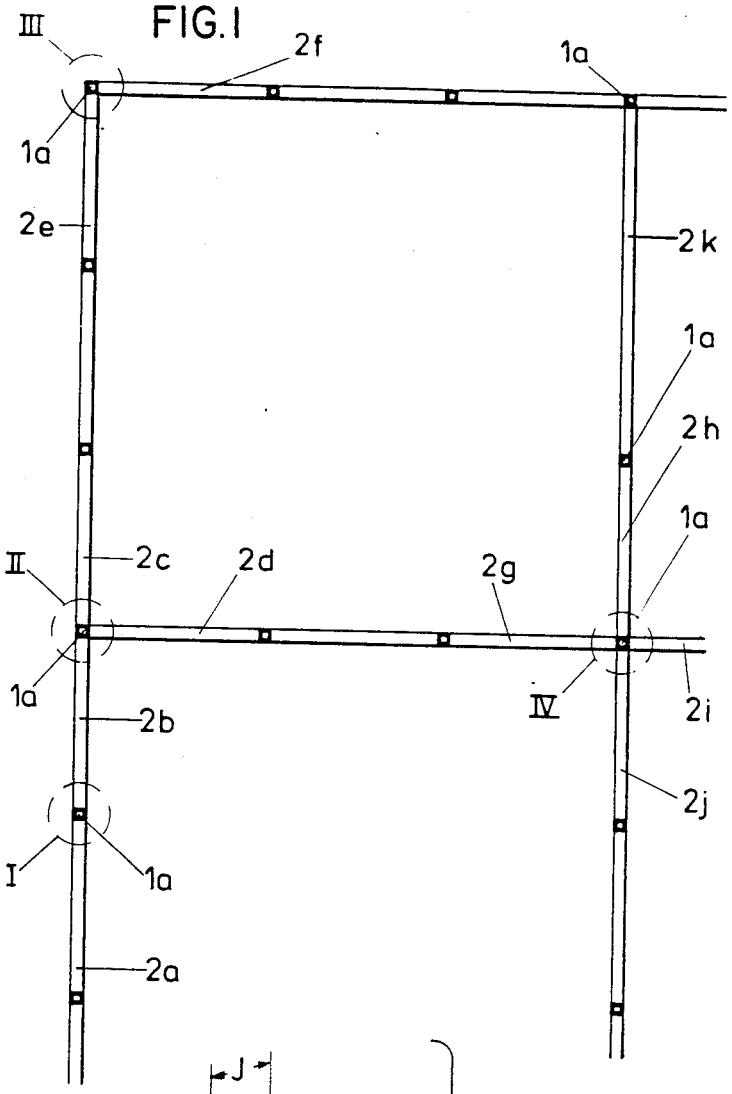
FIG. 1 is a side elevational view of a rapid-construction framework of the present invention, serving as support structure for ceiling and wall plates.
Figure 2:
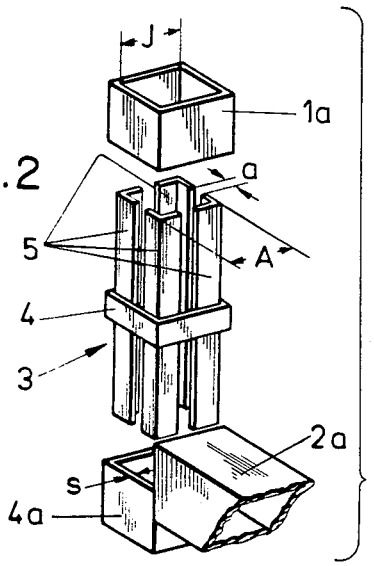
FIG. 2 is a perspective view of a first embodiment of a modular connection with a part each of a support and a tie bar shown in exploded relation.
Figure 3:
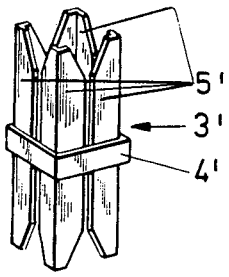
FIG. 3 is a perspective view of a second embodiment of the modular connection.

The plan of the rapid-construction framework, shown diagrammatically in FIG. 1, which can be for a building with an upper story, allows for five basic possibilities for the use of the modular connection 3 or 3' shown in FIGS. 2 and 3, respectively.

1. Supports 1, 1*a* and tie bars 2*a*, 2*b* of the rapid-construction framework can be fitted together in a straight line, forming a flat wall framework, as indicated in I in FIG. 1.

2. A second row of supports and therewith an additional wall framework can be attached on one wall side on each support 1, 1*a*, perpendicular to the first row of supports with tie bars 2*d*. This is indicated by II in FIG. 1.

3. Corners can be constructed (see FIG. 1, position III) with tie bars 2*e* and 2*f* and supports 1, 1*a*.

4. Intersecting tie bars 2*g*–2*j* can be attached to supports 1, 1*a*, as indicated by IV in FIG. 1, to support two adjacent walls, which can be perpendicular to a main wall.

5. Finally, a greater distance can be bridged over with a tie bar 2*k* of two or three times the modular length between each two supports 1, 1*a*, so that one or two supports can be dispensed with and a larger passageway can be maintained between two inside rooms of the building.

For all of the variations shown in FIG. 1, it is essential that these can be provided entirely with standard (modular) tie bars 2*a*–2*k* and also with support 1, 1*a* of hollow structural bars or beams, using modular connections 3 and/or 3'.

Modular connection 3 in FIG. 2 comprises a hollow structural bar segment 4 of low structural height, into which are symmetrically welded four shaped guide bars 5 of angular section. Hollow shaped segment 4 has the section dimensions of hollow supports 1, 1*a*. Shaped guide bars 5 are of the same length, but their length is many times longer than the structural height of hollow segment 4. Shaped guide bars 5 preferably are welded only on their lengthwise edges with the inside of hollow segment 4, The modular connection can also be manufactured as one integral unit (e.g. light die cast metal or cast iron), as indicated by 3' of FIG. 3.

Furthermore, it is important for the function of modular connection 3, 3' to have the space "a" between the four angular segments, as shown in FIG. 2. This space "a" may be only slightly greater than double the wall thickness "s" of hollow main elements 4*a*, 4*b* and so forth, which are welded onto the ends of the bars 2*a*, 2*b* and so forth, because this type of design assures a force-locking connection by simple fitting together of the structural elements. Therefore it is also important that the "structural play" be such that during the assembly of the parts which are to be assembled, only relatively slight friction is to be overcome. The edge dimensions "A" of modular connection 3, therefore, may be only slightly smaller than the small width "J" of supports 1, 1*a* as well as hollow main elements 4*a*, 4*b* and so forth, welded at the ends of tie bars 2*a*, 2*b* and so forth.

Hollow main elements 4*a*–4*j* are either of the same section as supports 1, 1*a* or, as is shown in the exemplary embodiments, are of half the size of the support section. The structural height of these main elements is lower than the structural height of the tie bars themselves. Furthermore, these main elements are welded offset downwardly or upwardly at the ends of the tie bars relative to the tie bar axes. It is also important that these elements 4*a*–4*j* can all be at the same level, so that tie bars 2*a*–2*k* can be mass produced as modules.

FIGS. 4–7 show main elements 4*a*–4*j* each coupled at the end of the corresponding tie bar with the top or bottom ends of supports 1, 1*a*, so that modular connections 3 with their four shaped guide bars 5 are inserted through hollow main elements 4*a*–4*j* engaging in the hollow space of supports 1, 1*a*. In this manner, with a modular connection 3 or 3', it is possible to attach two, three or four tie bars simultaneously to a bottom support 1 and a top support 1*a*.

Figure 4:
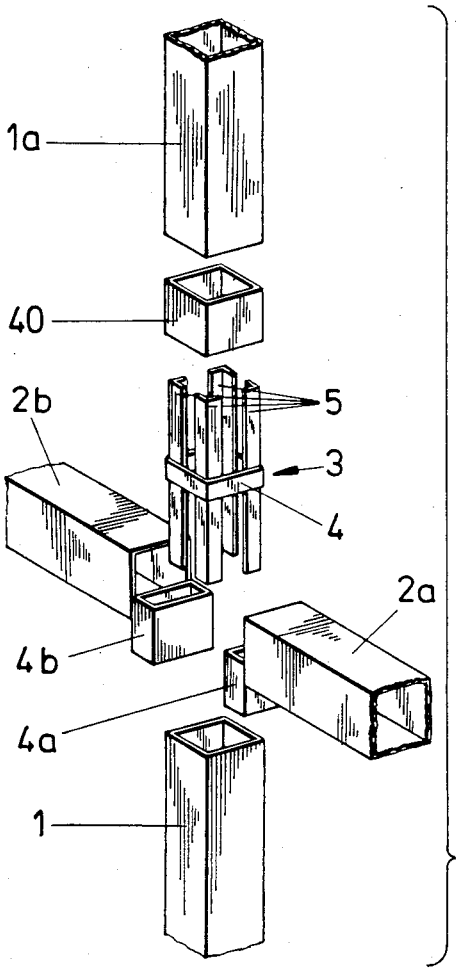
FIG. 4 is a perspective view of a portion of the rapid-construction framework in the area of the circle I of FIG. 1, showing the individual parts of the invention in exploded relation.
Figure 6:
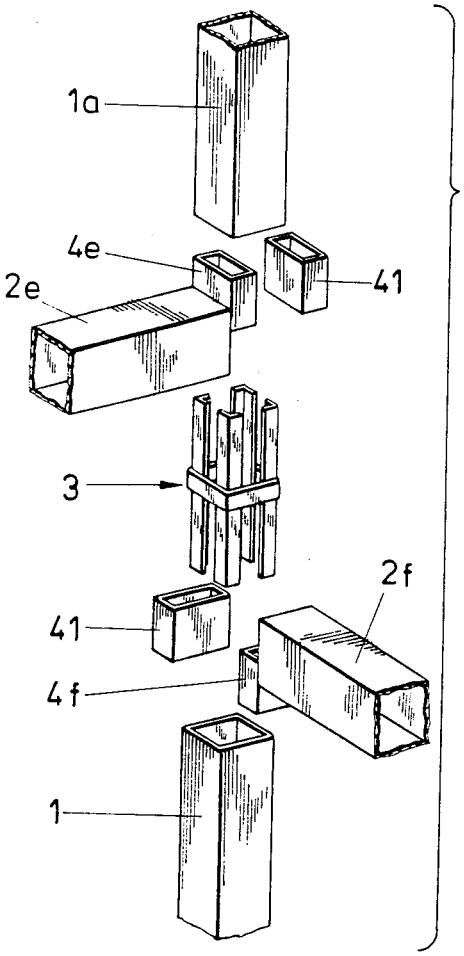
FIG. 6 is a perspective view of a portion of the rapid-construction framework in the area of the circle III of FIG. 1, with the parts in exploded relation.
Figure 5:
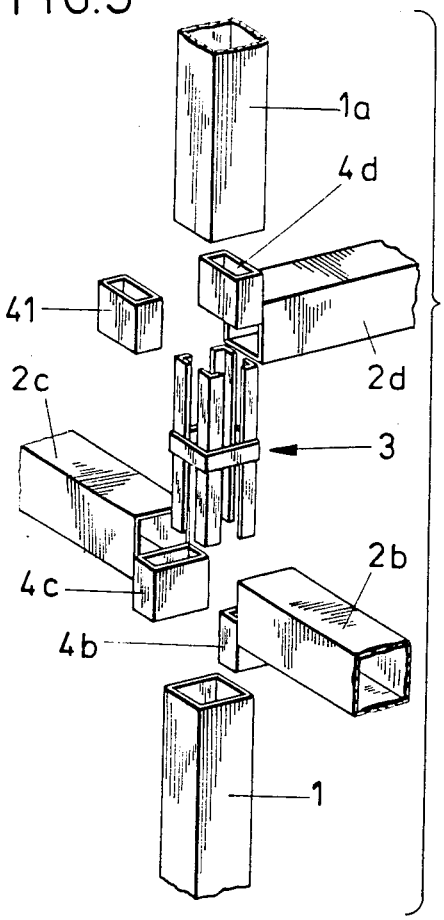
FIG. 5 is a perspective view of a portion of the rapid-construction framework in the area of the circle II of FIG. 1, with the parts in exploded relation.

Since the hollow main elements 4*a*–4*j* at the ends of tie bars 2*a*–2*i* generally have only half the section of supports 1, 1*a*, but have lower structural height than the entire coupling, e.g. in the cases of FIGS. 4, 5 and 6, additional leveling members 40 or 41 must be used. Leveling member 40 (FIG. 4) has the complete secion of supports 1, 1*a*, but leveling member 41 has only half the section of supports 1, 1*a*. On the other hand, both types of leveling members 40, 41, have the same structural height as main elements 4*a*–4*j* at the tie bar ends. Leveling members 40, 41 are therefore integrated as needed to assure force transmission between tie bars and supports in the couplings.

An assortment of modular parts is thus produced, which allows the necessary wall or room combinations in a rapid-construction framework, e.g., for a residence. Windows or doors or other passageways also can thus be provided between any two supports 1 or 1*a*.

FIG. 4 shows the area I of FIG. 1 in detail, wherein, to produce a straight wall, supports 1, 1*a* lie in a row and tie bars 2*a*, 2*b* are attached to supports 1, 1*a* by a modular connection 3 and a leveling member 40.

FIG. 5 shows the arrangement of area II of FIG. 1. In this case, a row of supports meets another row of supports perpendicular to it and therefore is attached to supports 1, 1*a* by means of modular connection 3 and also to the two tie bars 2*b* and 2*c*, both perpendicularly aligned with tie bar 2*d*, wherein a leveling member 41 which is identical with hollow main element 4*d* is required opposite element 4*d*.

FIG. 6 shows the coupling in the area III of FIG. 1, wherein tie bars 2*e* and 2*f* are connected force- and form-locking by modular connection 3 at a right angle to supports 1, 1*a*. Two leveling members 41 are required with this arrangement, which are identical with main elements 4*e* and/or 4*f* at the ends of tie bars 2*e* and 2*f*.

Figure 7:
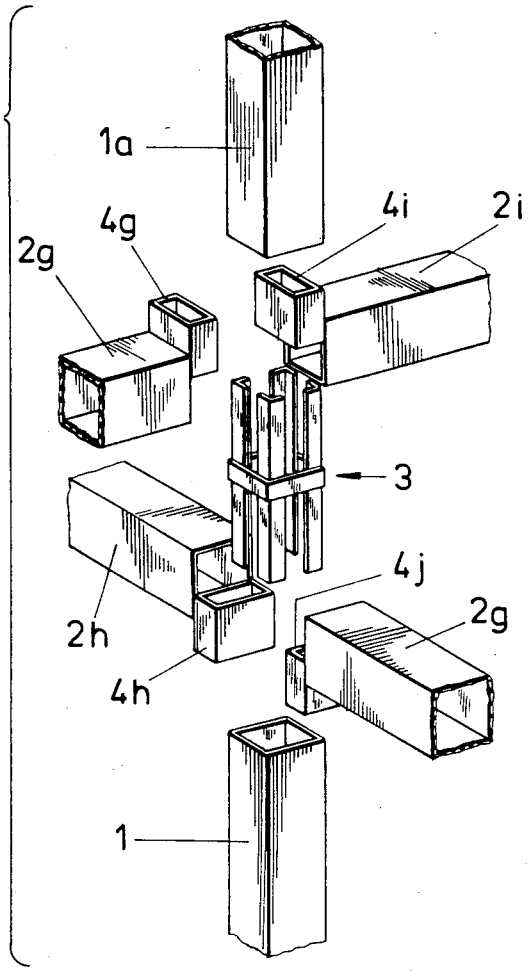
FIG. 7 is a perspective view of a portion of the rapid-construction framework in the area of the circle IV of FIG. 1, showing the parts in exploded relation.

FIG. 7 shows the area IV of FIG. 1. Modular connection 3 here provides the form- and force-locking connection of tie bars 2*g*, 2*h*, 2*i*, 2*j* intersecting with supports 1, 1*a*.

Figure 8:
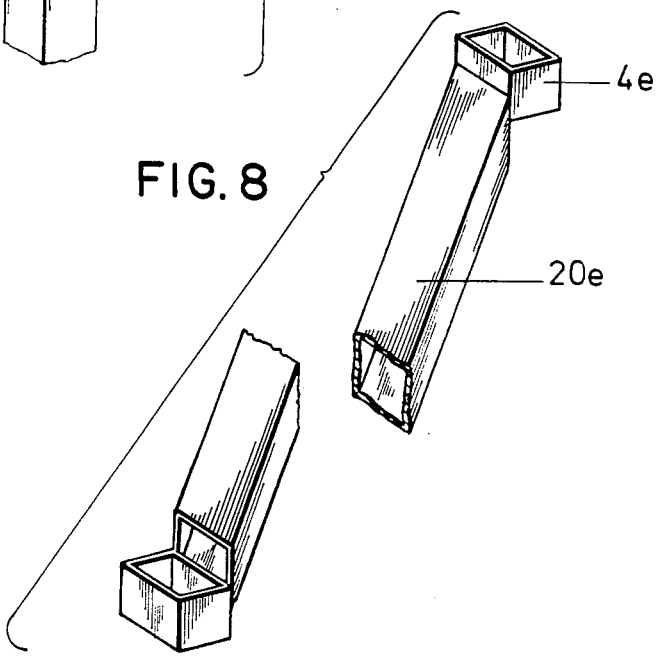
FIG. 8 is a perspective view of some diagonal sections of the rapid-construction framework.

FIG. 8 shows a diagonal 20*e* which can be arranged between two adjacent supports 1, which however requires the use of modular connections 3, of which shaped guide bars 5 instead of hollow segment 4 extend downwardly for the length of hollow main element 4*e*. Leveling member 41 which is then required must likewise have double structural height.

What is claimed is:

1. Rapid-construction framework as support structure for ceiling and wall plates of a building with hollow supports and laterally extending tie bars substantially perpendicular thereto, each tie bar having a coupling element on both ends thereof to produce plug connections with bottom and/or top supports, wherein each coupling element comprises hollow main elements with an interior width secured on the tie bars and shaped guide bars of angular section slidably receivable in said main elements, characterized in that four of said shaped guide bars (5) are fitted together in spaced relation to form an independent modular connection (3), while the main elements (4*a*–4*j*) of the rapid-construction framework on the tie bars are of lightweight substantially rectangular section and are of the same dimensions for their assembly, said four shaped guide bars (5) of modular connection (3) being secured within a hollow segment (4) of lower structural height than the guide bars, the cross section of the hollow segment (4) corresponding substantially to the cross section of the supports, the space "a" between each two of the four shaped guide bars (5) in the modular connection (3) being slightly greater than double the wall thickness "s" of the hollow main elements (4*a*–4*j*) at the ends of tie bars (2*a*–2*k*), the outer edge dimensions of modular connection (3) being only slightly smaller than the interior width "J" of the hollow main elements (4*a*–4*j*) and supports (1, 1*a*), and the hollow main elements being of a cross-sectional size that is approximately one-half of the inside cross section of the supports (1, 1*a*) such that two adjacent main elements can be fitted within a support to fill the space therein and secure the adjacent tie bars thereto.

2. Rapid-construction framework as in claim 1, characterized in that modular connection (3') is produced as one integral cast element.

3. Rapid construction network as in claim 1 wherein the main elements (4*a*–4*j*) are secured on the ends of the tie bars (2*a*–2*k*) in offset relating thereto such that they extend outwardly from one side of the tie bars.

4. Rapid construction network as in claim 1 further comprising leveling members (40,41) having a size and shape substantially the same as said main elements (4*a*–4*j*), said leveling members extending over the guide bars (5) and into the supports (1, 1*a*) when only one or none of the main elements extend therein.

* * * * *